US008734040B2

(12) United States Patent
Roberts et al.

(10) Patent No.: US 8,734,040 B2
(45) Date of Patent: May 27, 2014

(54) MULTI-FUNCTION WRITING INSTRUMENT WITH PROPULSION MECHANISM

(75) Inventors: Michael Roberts, Tiverton, RI (US); George Reekie, Bristol, RI (US); Ramon T. Kingsley, Providence, RI (US)

(73) Assignee: A.T.X. International, Inc., Lincoln, RI (US)

( * ) Notice: Subject to any disclaimer, the term of this patent is extended or adjusted under 35 U.S.C. 154(b) by 513 days.

(21) Appl. No.: 13/156,807

(22) Filed: Jun. 9, 2011

(65) Prior Publication Data

US 2012/0315074 A1 Dec. 13, 2012

(51) Int. Cl.
*B43K 24/14* (2006.01)
*B43K 27/02* (2006.01)

(52) U.S. Cl.
CPC ..... *B43K 24/146* (2013.01); *B43K 27/02* (2013.01)
USPC ..... 401/30; 401/29

(58) Field of Classification Search
CPC ..... B43K 24/00; B43K 24/10; B43K 24/14; B43K 24/146; B43K 27/02
USPC ..... 401/29, 30
See application file for complete search history.

(56) References Cited

U.S. PATENT DOCUMENTS 3,135,242 A 6/1964 Helitas
4,202,641 A 5/1980 Tomura
4,221,490 A 9/1980 Malm
4,227,822 A 10/1980 Kokubu
4,283,151 A 8/1981 Sekiguchi
4,290,707 A 9/1981 Ariga
4,352,580 A 10/1982 Ando
4,533,271 A 8/1985 Sansevero
4,895,467 A 1/1990 Kageyama et al.
4,904,101 A 2/1990 Petterson
5,018,891 A 5/1991 Kageyama et al.
5,022,774 A 6/1991 Kageyama et al.
5,056,947 A 10/1991 Kubota et al.
5,062,727 A 11/1991 Kageyama et al.
5,193,927 A 3/1993 Kageyama et al.
5,207,522 A 5/1993 Kageyama et al.
5,236,270 A 8/1993 Kageyama et al.
5,306,085 A 4/1994 Kobayashi
5,306,107 A 4/1994 Kageyama et al.
5,370,471 A 12/1994 Kageyama et al.
5,547,404 A 8/1996 Nellis, Jr. et al.
5,549,404 A 8/1996 Kageyama et al.
5,553,956 A 9/1996 Mitsuya et al.

(Continued)

*Primary Examiner* — David Walczak
*Assistant Examiner* — Joshua Wiljanen
(74) *Attorney, Agent, or Firm* — Notaro, Michalos & Zaccaria P.C.

(57) ABSTRACT

A multi-function writing instrument includes a front section having a writing point opening and a rear section having an eraser opening. The rear section and the front section are rotatably connected to each other. A plurality of marking tips are disposed in the front section. One of the marking tips is a pencil lead marking tip. The marking tips are alternately selectable for extension through the writing point opening. An eraser holder is movably disposed in the rear section. An eraser is mounted in the eraser holder. The eraser holder is selectable for extension through the eraser opening. A means for simultaneously propelling the pencil lead marking tip through the writing point opening and the eraser through the eraser opening upon rotation of the front section relative to the rear section is housed in the multi-function writing instrument.

31 Claims, 13 Drawing Sheets

(56) References Cited

U.S. PATENT DOCUMENTS

| | | | | |
|---|---|---|---|---|
| 5,642,953 | A | 7/1997 | Kobayashi et al. | |
| 9,662,425 | | 9/1997 | Mitsuya | |
| 5,683,191 | A | 11/1997 | Kageyama et al. | |
| 5,700,101 | A | 12/1997 | Kageyama et al. | |
| 5,803,637 | A | 9/1998 | Mitsuya | |
| 5,876,136 | A | 3/1999 | Tsutsumi et al. | |
| 9,890,825 | | 4/1999 | Kageyama et al. | |
| 5,927,882 | A | 7/1999 | Kageyama | |
| 5,961,236 | A | 10/1999 | Kageyama | |
| 5,988,914 | A | 11/1999 | Kageyama et al. | |
| 6,039,484 | A | 3/2000 | Kageyama et al. | |
| 6,082,917 | A | 7/2000 | Noguchi et al. | |
| 6,155,734 | A | 12/2000 | Kageyama et al. | |
| 6,210,058 | B1 | 4/2001 | Kageyama et al. | |
| 6,412,998 | B1 | 7/2002 | Ham | |
| 6,447,193 | B1 | 9/2002 | Kageyama et al. | |
| 6,517,272 | B1 | 2/2003 | Kageyama et al. | |
| 6,547,465 | B1 | 4/2003 | Rago et al. | |
| 6,729,785 | B2 | 5/2004 | Wijerama | |
| 6,939,069 | B2 | 9/2005 | Odaka | |
| 6,994,484 | B2 | 2/2006 | Kageyama et al. | |
| 7,008,131 | B2 * | 3/2006 | Kagevarna et al. | 401/30 |
| 7,284,927 | B2 | 10/2007 | Kageyama | |
| 7,329,063 | B2 | 2/2008 | Kato | |
| 2002/0085874 | A1 | 7/2002 | Kagevarna et al. | |
| 2004/0028451 | A1 | 2/2004 | Wijerama | |
| 2006/0291947 | A1 | 12/2006 | Kageyama | |

* cited by examiner

MULTI-FUNCTION WRITING INSTRUMENT WITH PROPULSION MECHANISM

FIELD AND BACKGROUND OF THE INVENTION

The present invention relates generally to the field of writing instruments and in particular to a new and useful writing instrument configured with multiple independently selectable marking tips.

Multi-function writing instruments provide the user with multiple writing tip options within the same writing implement, which reduces the number of writing instruments to carry.

Typical multi-function writing instruments include both ink-based and lead pencil tips. Maximum use of the lead pencil tip can be achieved through use of an eraser which is typically fixed to the writing instrument. Since the eraser will only be used in connection with the lead pencil tip, the eraser is typically either covered while not in use or always exposed.

An example of the former method is the use of screw-top eraser covers on multi-function instruments. These screw-on covers require an extra step in the use of the writing instrument, reducing the enjoyment and utility of their use. Further, the cover is a separate part that is liable to be lost and negatively impacts the aesthetics and style of the writing instrument.

In the past, there have been proposed writing instruments having only a single writing cartridge in which a writing tip and an eraser are simultaneously projected or retracted from opposite open ends of the writing instrument. Such a writing instrument is disclosed in, for example, U.S. Pat. No. 4,221,490 to Malm. Other proposed writing instruments have multiple cartridges and an eraser which is projected independently without any coordination with the projection of the writing tip. Such a writing instrument is disclosed in, for example, U.S. Pat. No. 5,890,825 to Kageyama.

The constructions of these prior writing instruments, however, are complicated and fail to provide a projection and retraction mechanism for simultaneously projecting and retracting a lead pencil tip and an eraser in a multi-function writing instrument.

SUMMARY OF THE INVENTION

It is an object of the present invention to provide a multi-function writing instrument with an automatic projecting eraser, which only projects when the lead pencil tip is selected for use. Thus, this writing instrument matches the eraser's availability to the user's demand.

It is a further object of the invention to provide a multi-function writing instrument with a relatively simple and inexpensive project and retract mechanism capable of simultaneously projecting or retracting a lead pencil tip and an eraser from opposite ends of a multi-function writing instrument.

For achieving the aforementioned objects, according to the present invention, there is provided a multi-function writing instrument of the invention having two complimentary bodies, such as an upper barrel and a lower barrel, which are joined to form a single writing instrument for use as a mechanical pencil and a ballpoint pen, non-marking stylus, fountain pen, rolling ball or felt-tip marker, or any other type of marking instrument. The lower barrel has a chamber for holding the mechanical pencil element, including the lead pencil, and one or more ink cartridges or other types of marking implements, e.g., stylus. The writing tips of the lead pencil and the ink cartridges are extendable one at a time through an opening in the lower barrel writing tip.

The non-writing tip end of the lower barrel is open and forms a sleeve for rotatably connecting to the upper barrel. The upper barrel has an eraser opening at its free end opposite the writing tip opening. An eraser holder for supporting an eraser is movably housed in the upper barrel. The eraser holder has an eraser follower in the form of a protuberance on the surface of the eraser holder. The eraser holder preferably includes a mounting part for holding the eraser and a stem. An eraser holder spring which is mounted in the upper barrel urges the eraser holder away from the eraser opening.

A means for propelling simultaneously the pencil lead marking tip through the writing point opening and the eraser through the eraser opening in the upper barrel is housed in the barrel of the writing instrument. The means for propelling includes a guide connected to the lower barrel. The guide has a first guide end and a second guide end. The guide also includes a plurality of channels which are aligned with a center axis of the guide and extend between the first guide end and the second guide end.

A cam follower is slidably mounted in each of the channels. The cam follower is connected to a refill holder or a lead pencil holder, such as a mechanical pencil implement, which are stored in the barrel of the writing instrument. Each cam follower is operatively connected to a writing or marking tip. A means for biasing urges each cam follower toward the eraser opening in the upper barrel. The biasing means preferably comprises a helical spring which is coiled around the refill holder and abuts inner wall of the first guide end and the cam follower.

A first cam is rotatably connected to the guide. The first cam includes a first cam path having a first cam apex. The cam followers travel on the first cam path upon rotation of the first cam relative to the guide. The first cam apex urges the cam follower against the force of the cam follower spring toward the writing point opening. The writing tip which is connected to the cam follower that is being urged by the first cam apex passes through the writing point opening to the use position. The first cam imparts a translational movement to the cam follower, which, in turn, causes the writing tip to linearly move parallel the longitudinal axis of the writing instrument.

A second cam is also rotatably connected to the guide. The second cam includes a second cam path having a second cam apex. The eraser follower travels on the second cam path upon rotation of the second cam relative to the guide. The second cam apex urges the eraser follower to move toward the eraser opening against the force of the eraser holder spring. The eraser holder undergoes a translational displacement which, in turn, causes the eraser to pass through the eraser opening.

The eraser projects through the eraser opening upon selection of the lead pencil. The lead pencil is selected upon rotation of the upper barrel relative to the lower barrel. The eraser projects through the eraser opening simultaneously when the pencil lead tip projects through the writing tip opening.

To operate the multi-function writing instrument, the upper barrel is turned relative to the lower barrel. The rotation propels and repels individually in succession the writing tips of the ink refill and the lead pencil. Upon propelling the lead pencil tip, the eraser projects through the opening of the upper barrel. Thus, the eraser is available for use only when the pencil writing tip is projected, which is the only time the user would need to use the eraser.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
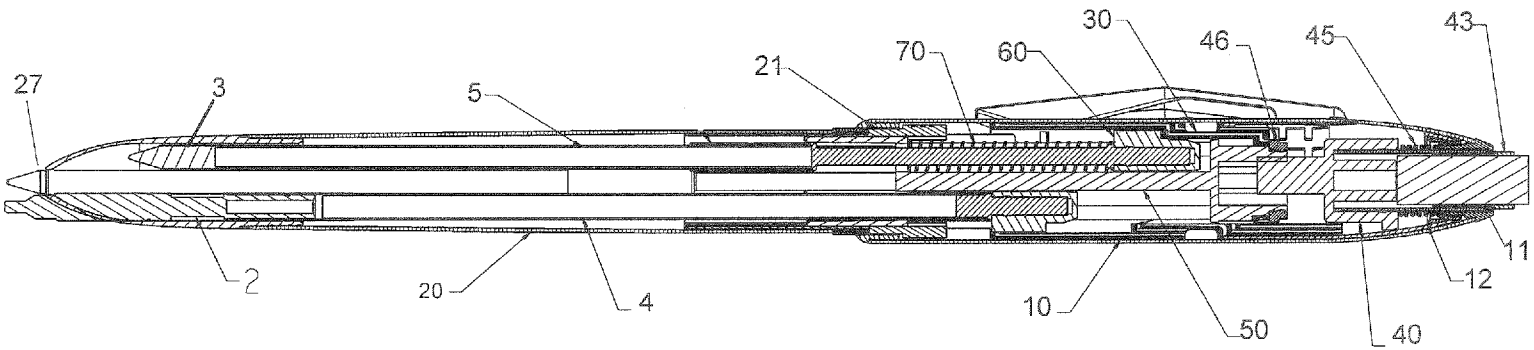
FIG. 1 is a cross-sectional view of the multi-function writing instrument according to the invention.
Figure 2:
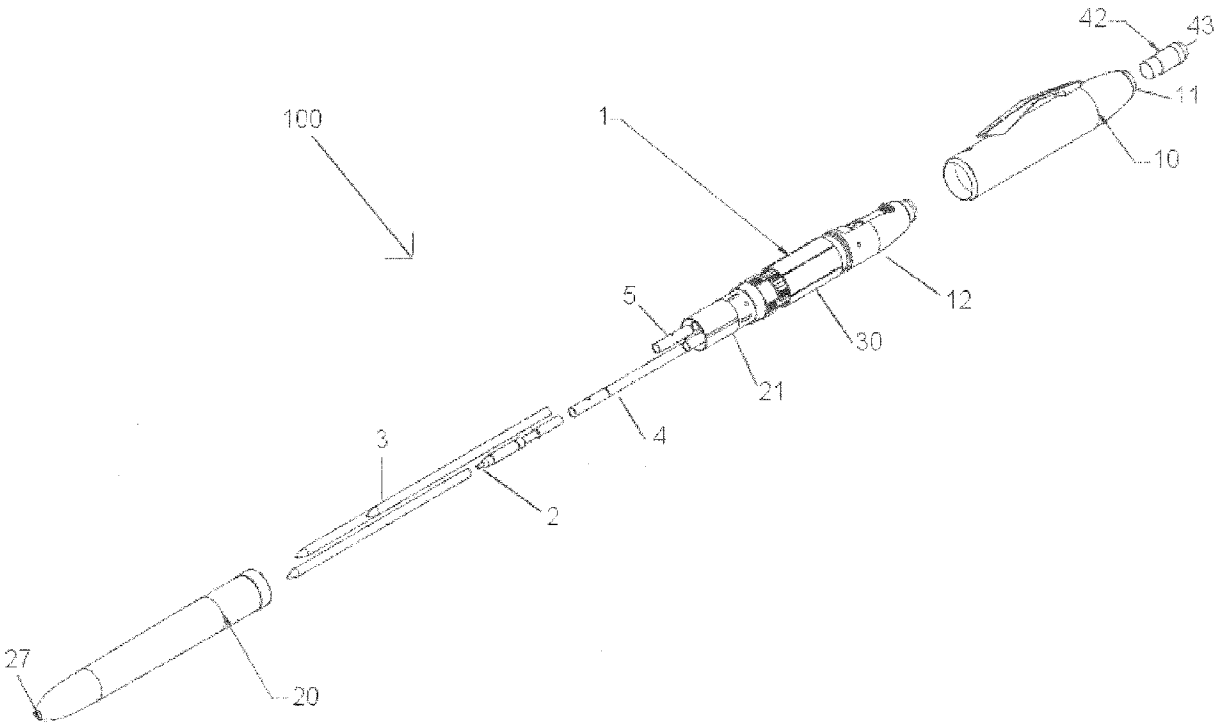
FIG. 2 is an exploded view of a multi-function writing instrument according to the invention.
Figure 3:
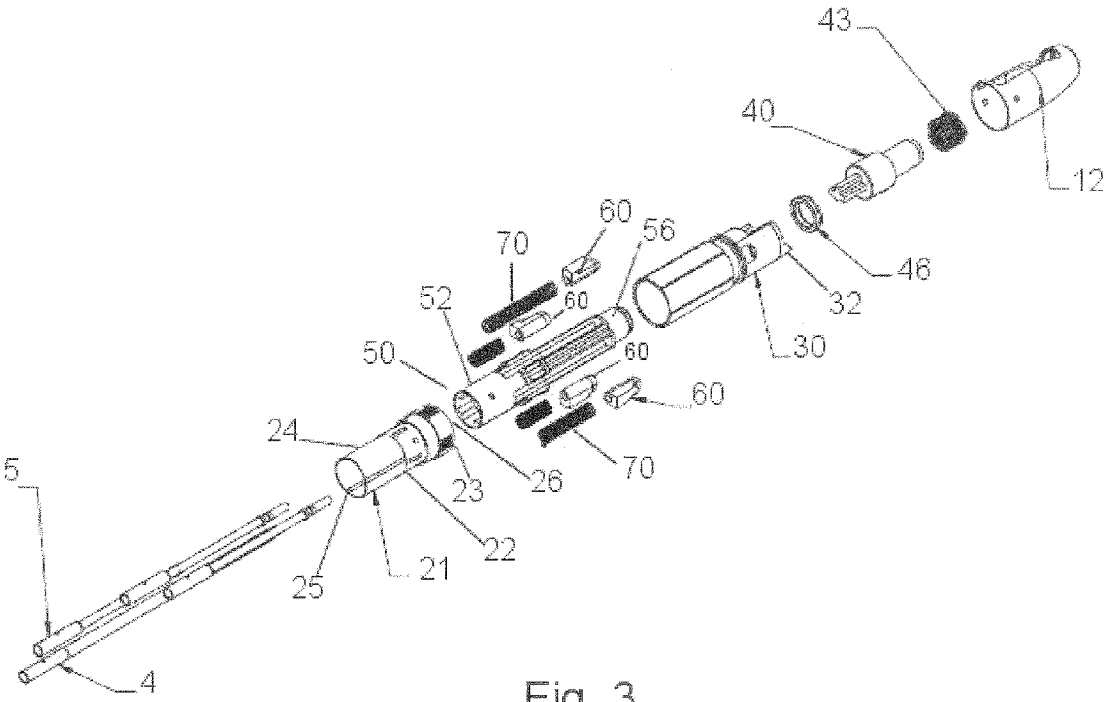
FIG. 3 is an exploded view of the propulsion mechanism according to the invention.

Referring now to the drawings, in which like reference numerals are used to refer to the same or similar elements, FIGS. 1, 2 and 3 show views of a multi-function writing instrument 100 having a propulsion mechanism 1. The multi-function writing instrument, as shown in FIG. 1, has a rear section 10, e.g., an upper barrel, a cap, and a front section 20, e.g., a lower barrel. The propulsion mechanism 1, shown assembled in FIG. 2, simultaneously propels a lead pencil tip 2 through a writing tip opening 27 in the lower barrel 20 and an eraser 43 through an eraser opening 11 in the upper barrel 10. The simultaneous propulsion of the lead pencil tip 2 and the eraser 43 is caused by rotating the upper barrel 10 relative to the lower barrel 20.

Referring to FIGS. 2 and 3, the propulsion mechanism 1 is housed in the upper barrel 10. The propulsion mechanism 1 includes a guide 50, a cam assembly 30, cam followers 60 and an eraser holder 40.

A barrel insert 21 is coaxially disposed inside and fixed to the lower barrel 20 against relative rotation. The barrel insert 21 connects the guide 50 to the lower barrel 20. The barrel insert 21 has a hollow cylindrical body 22, a neck 23, a stem 24, a top opening 26 and a bottom opening 25. The neck 23 has a larger inner diameter than the stem 24. The guide 50 is received in the top opening 26 and neck 23 of the barrel insert 21. Inwardly facing protuberances (not shown) on the inside of the barrel insert 21 fix the guide 50 inside the barrel insert 21. The lower barrel 20, the guide 50 and the barrel insert 21 are fixed against relative movement.

Figure 4:
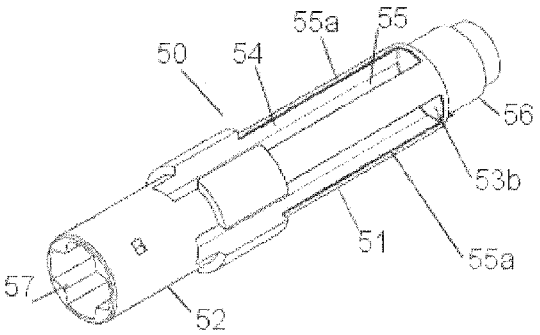
FIG. 4 is a perspective view of the guide according to the invention.
Figure 5:
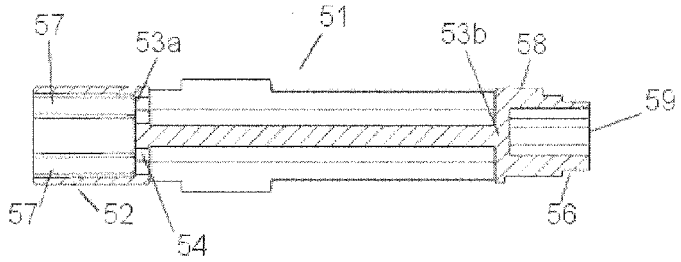
FIG. 5 is a cross-sectional view of the guide according to the invention.
Figure 7:
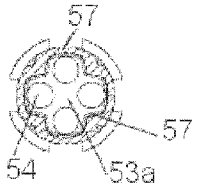
FIG. 7 is a cross-sectional view of the guide according to the invention taken along lines 7-7 of FIG. 6.
Figure 8:
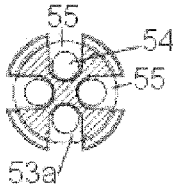
FIG. 8 is a cross-sectional view of the guide according to the invention taken along lines 8-8 of FIG. 6.

Referring to FIGS. 4 and 5, the guide 50 includes a main body 51, a base 52 disposed at the bottom end of the main body 51 and a drum 56 disposed at the top end of the main body. The main body 51, base 52 and drum 56 are centrally aligned. A first inner wall 53*a* separates the main body 51 and the base 52. The first inner wall 53*a* has a plurality of openings 54, shown in FIGS. 7 and 8. A second inner wall 53*b* separates the main body 51 and the drum 56. The second inner wall 53*b* and the first inner wall 53*a* are parallel each other.

Figure 6:
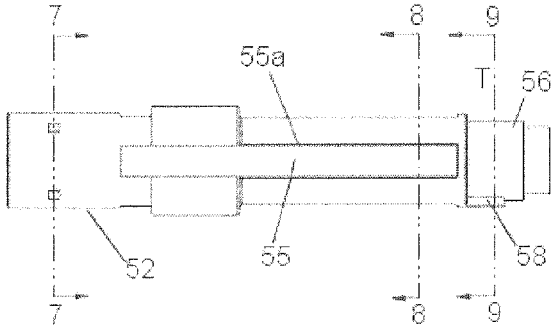
FIG. 6 is a side elevational view of the guide according to the invention.
Figure 9:
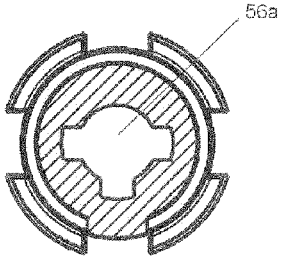
FIG. 9 is a cross-sectional view of the guide according to the invention taken along lines 9-9 of FIG. 6.

The drum 56 has an opening 59 opposite the second inner wall 53*b*. Referring to FIG. 9, the opening 59 is preferably T-shape. Referring to FIGS. 5 and 6, a projection 58 is disposed on an exterior surface of the drum 56. The projection 58 preferably has a rectangular shape.

A plurality of channels 55 are formed in the main body 51 of the guide 50 between the first inner wall 53*a* and the second inner wall 53*b*. Each channel 55 has a top opening defined by edge 55*a* on the exterior surface of the main body 51. The channels 55 are circumferentially spaced equally from each other around the longitudinal axis of the main body 51. Each channel 55 is aligned with an opening 54 of the first inner wall 53*a*.

The base 52 of the guide 50 is disposed in the neck 23 of the barrel insert 21. A plurality of grooves 57 are formed on the inner surface of the base 52. Each groove 57 is aligned with an opening 54 of the first inner wall 53*a*.

The guide 50 may comprise a single molded piece formed of a plastic material.

Figure 10:
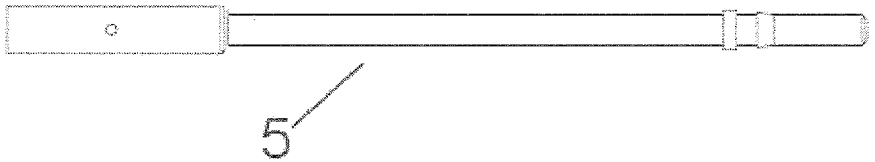
FIG. 10 is a side elevational view of the refill holder according to the invention.

A lead pencil holder 4 (see FIGS. 2 and 3) connects the lead pencil 2 to the propulsion mechanism 1. The lead pencil holder 4 is a common type of holder as used in mechanical pencils. Refill holders 5, shown in FIG. 10, connect ink refills 3, or other types of marking implements, e.g., stylus, to the propulsion mechanism 1.

Figure 11:
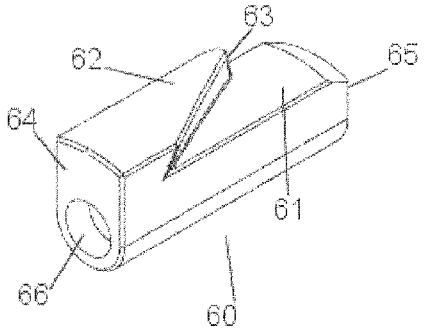
FIG. 11 is a perspective view of the cam follower according to the invention.
Figure 12:
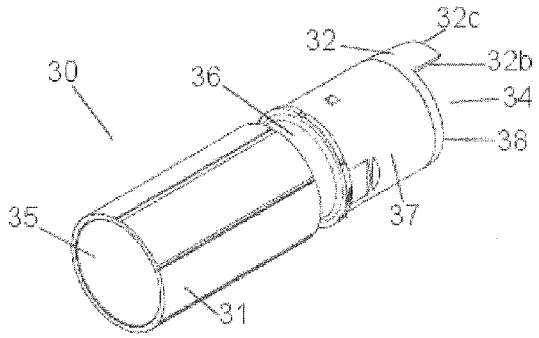
FIG. 12 is a perspective view of the cam assembly according to the invention.
Figure 13:
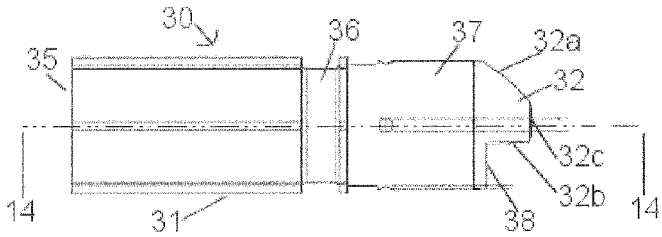
FIG. 13 is a side elevational view of the cam assembly according to the invention.
Figure 14:
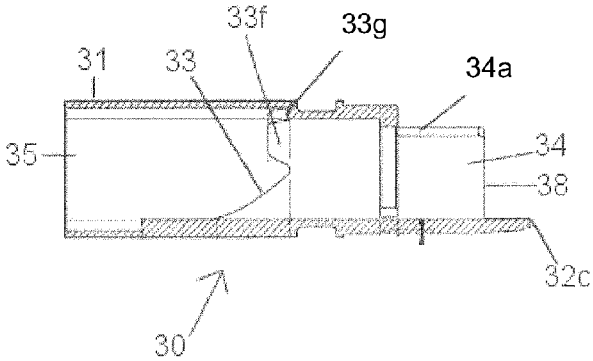
FIG. 14 is a cross-sectional view of the cam assembly according to the invention taken along lines 14-14 of FIG. 13.
Figure 15:
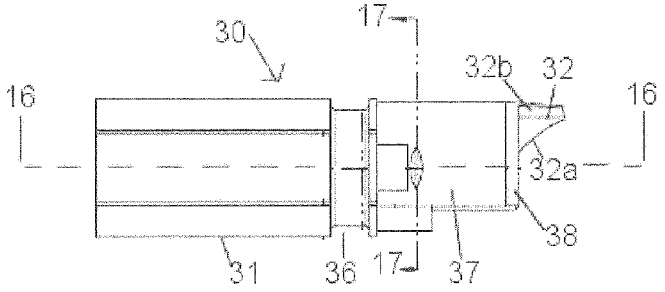
FIG. 15 is a side elevational view of the cam assembly according to the invention.
Figure 16:
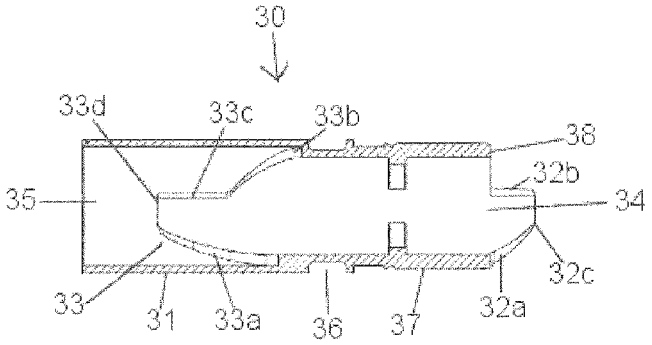
FIG. 16 is a cross-sectional view of the cam assembly according to the invention taken along lines 16-16 of FIG. 15.
Figure 17:
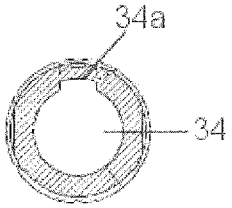
FIG. 17 is a cross-sectional view of the cam assembly according to the invention taken along lines 17-17 of FIG. 15.

Referring to FIGS. 1 and 3, a cam follower 60 is slidably mounted in the channel 55 of the guide 50. Each holder 4,5 passes through an aligned opening 54 in the first inner wall 53 and slidably engages a groove 57 disposed in the inner surface of the base 52. Referring to FIG. 11, each cam follower 60 includes a front platform 61, a raised profile 62 that extends from the front platform 61, a bottom wall 64 with an opening 66 and a top wall 65. The raised profile has a step 63. The step 63 is offset from the top wall of the cam follower 60. The step 63 lies on a different plane from and below the plane of the top wall 65. The opening 66 receives an end of the lead pencil holder 4 or the refill holder 5 for connecting the cam follower 60 thereto.

The lead pencil cam follower 60 is connected to the lead pencil holder 4. Both the lead pencil cam follower 60 and the channel 55 in which the cam follower 60 is slidably disposed are aligned with the projection 58 of guide 50. The projection 58 is preferably located proximate the top end of the channel 55 which receives the lead pencil cam follower 60. Each of the other cam followers 60 is connected to a refill holder 5.

The raised profile 62 of the cam follower 60 extends out of the opening of the channel 55 above the edge 55*a*.

Referring to FIG. 3, a guide spring 70 is disposed in each channel 55. The guide spring 70 is preferably helical and adapted to allow the lead holder 4 or a refill holder to pass through its center opening. The guide spring 70 is biased between the bottom wall 64 of the cam follower 60 and the first inner wall 53*a*. The guide spring 70 urges the cam follower 30 in the direction of the eraser opening 11 so that the top wall 65 of the cam follower 60 abuts the second inner wall 53*b*.

Referring to FIGS. 12-17, the cam assembly 30 has a cylindrical hollow body 31, a forward facing cam 33 (shown in FIGS. 14 and 16) and a backward facing cam 32. The cylindrical hollow body 31 includes a top opening 34, a bottom opening 35 and a circumferential groove 36 formed on the exterior surface of the cylindrical hollow body 31. The top opening 34 includes a slot 34*a* adapted to receive the projection 58 of the guide 50. The top end of the hollow body 31, proximate the backward facing cam 32, includes a curved wall 37 having and a top edge 38.

The backward facing cam 32 extends from the top edge 38 of the curved wall 37. The backward facing cam 32 includes a slanted edge 32*a*, a vertical straight edge 32*b* which is perpendicular to the top edge 38, and an apex 32*c* located between the slanted edge 32*a* and the vertical straight edge 32*b*, which all define a path adapted for travel by an eraser holder follower 44.

The forward facing cam 33 is disposed inside the hollow body 31. The forward facing cam 33 is preferably integral with the inner surface of the hollow body. The forward facing cam 33 can also be a separate member that is disposed in the hollow body 31.

The forward facing cam 33 includes connected paths adapted for travel of the cam followers 60. The connected paths include a first sloped path 33*a*, a second shorter sloped path 33*b*, a short vertical path 33*c* that extends from the second sloped path 33*b*, an apex 33*d* that connects the first sloped path 33*a* and the short vertical path 33*c* and a circumferential path that is connected to the first sloped path 33*a* and the second shorter sloped path 33*b*. The circumferential path includes a plurality of recesses 33*f*, preferably three (3). A ridge 33*g* separates each recess 33*f*.

The pitch, length and direction of the first cam's path is different from the pitch, length and direction of the second cam's path to allow for different translational displacements of the eraser and writing tip.

The apex of the backward facing cam and/or the apex of the forward facing cam preferably have a flat, straight edge. The apex of the backward facing cam and/or the apex of the forward facing cam also preferably have a curved profile with an angle of rotation of 5 degrees to 45 degrees, more preferably from 5 degrees to 36 degrees, and most preferably from 5 degrees to 24 degrees.

The cam assembly 30 is rotatably mounted to and axially slidable in the guide 50. The projection 58 of the guide 50 is shaped and sized to slidably engage the slot 34*a* in the top opening 34 of the cam assembly 30. The cam assembly 30 is not rotatable relative to the guide 50 when the projection 58 is engaged with the slot 34*a*. The engagement of the projection 58 and the slot 34*a* allows the cam assembly 30 and thus, the upper barrel 10, to axially slide forward for knocking the lead pencil holder 5 to advance the lead pencil 2 through the writing tip opening 27.

A ring 46, shown in FIGS. 1 and 3, prevents the guide 50 from falling out of the cam assembly 30. The ring 46 is affixed to the free end of the drum 56 of the guide 50. The ring 46 is sized and dimensioned so that it does not fit through the top opening 34 of the cam assembly 30. Thus, when the guide 50 moves downward relative to the cam assembly 30, the ring 46 will travel with the guide 50 and then abut the outer edge of the opening 34, preventing further axial movement of the guide 50.

The slot 34*a* formed in the top opening 34 of the cam assembly 30 is aligned with and on the same plane as the apex 33*d* of the forward facing cam 33. The slot 34*a* is also diametrically aligned with the apex 32*c* of the backward facing cam 32.

Referring to FIG. 2, an upper barrel insert 12 is disposed in the upper barrel 10, preferably by a tight press connection or a friction fit, so that the upper barrel insert 12 and the upper barrel 10 are fixed against relative rotation. The upper barrel insert 12 connects the cam assembly 30 to the upper barrel 10. The upper barrel insert 12 has a hollow body with openings at opposite ends thereof. The backward facing cam 32 is rotatably mounted in the upper barrel insert 12.

Figure 18:
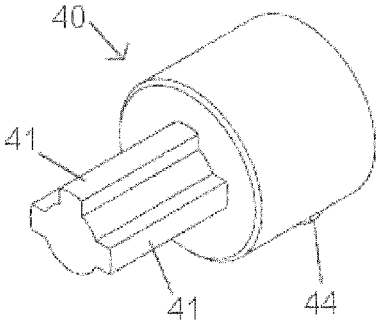
FIG. 18 is a perspective view of the eraser holder according to the invention.
Figure 19:
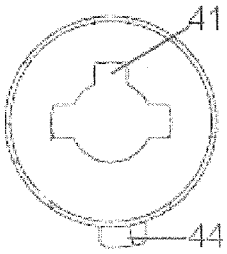
FIG. 19 is a top view of the eraser holder according to the invention.

Referring to FIG. 1, the eraser holder 40 is non-rotatably connected to the drum 56 of the guide 50. As shown in FIGS. 18 and 19, the eraser holder 40 has projections 41 that engage the opening 59 of the guide 50 to preferably form a splined connection. The eraser holder 40 and the guide 50 rotate in unison. The eraser holder 40 is also free to slide axially in the opening 59. A ferrule 42, shown in FIG. 2, is fixed to the top end of the eraser holder 40. An eraser 43 is mounted in the ferrule 42.

The eraser 43 is axially displaced from a retracted position, where it is housed inside the upper barrel insert 12, to an extended position, where it extends through the eraser opening 11 for use. The eraser holder 40 has an eraser follower 44 disposed on the exterior surface proximate the top end of the eraser holder 40. The eraser follower 44 travels on the path of the backward facing cam 32 upon rotation of the guide 50 relative to the cam assembly 30 for propelling the eraser 43 from its retracted position to its extended position. The propulsion of the eraser 43 is simultaneous or substantially simultaneous with the propulsion of the lead pencil tip through the writing tip opening 27 of the lower barrel 20.

An eraser spring 45, shown in FIG. 1, is housed in the upper barrel insert 12. The eraser spring 45 urges the eraser holder 40 to the retracted position. The eraser spring 45 preferably includes helical coils which receive the ferrule 42. The top end of the eraser spring 45 abuts against the inner surface of the upper barrel insert 12. The bottom end of the spring 45 abuts the top end of the eraser holder 40. The eraser holder 40 is retracted unless acted upon by the backward facing cam 32.

The guide 50 is fixed to the lower barrel 20. The cam assembly 30, in turn, is fixed to the upper barrel 10. Rotation of the lower barrel 20 relative to the upper barrel 10 causes actuation of the writing instrument by rotating the guide 50 relative to the cam assembly 30. The cam assembly 30 urges the cam followers 60 to travel in the guide channels 55 toward the writing tip opening 27 of the lower barrel 20 to propel a writing tip. Rotation of the lower barrel 20 relative to the upper barrel 10 is continued until the desired refill 2,3 is propelled.

The step 63 of the cam follower 60 travels on the path of the forward facing cam 33 upon rotating the lower barrel 20 relative to the upper barrel 10. The step 63 sits in the recess 33*f* when the writing tip of the refill 2,3 is inside the lower barrel 20. Upon rotating the lower barrel 20 relative to the upper barrel 10, the step 63 travels on the recesses 33*f*. Upon further rotation, the step 63 climbs the first slope 33*a* until it reaches and abuts against the apex 33*d*. The apex 33*d* pushes the cam follower 60 against the force of the guide spring 70 housed in the channel of the guide 50. The writing tip passes through the writing tip opening 27 of the lower barrel 20 when the step 63 of the cam follower 60 abuts against the apex 33*d* of the forward facing cam 33. Continual rotation of the lower barrel 20 relative to the upper barrel 10 causes the step 63 of the cam assembly 30 to travel off of the apex 33*d* and onto the straight path 33*c*, the second slope 33*b* and return to the recesses 33*f*.

The relative rotation of the cam assembly 30 and the guide 50 also actuates the projection of the eraser 43 through the top opening of the upper barrel assembly 10. The eraser holder follower 44 sits on the top edge 38 of the of the cam assembly 30 when the eraser 43 is in the retracted position. Rotation of the cam assembly 30 causes the eraser holder follower 44 to travel on the backward facing cam 32, which, in turn, causes the eraser holder 40 to move axially against the force of the eraser spring 45. When the eraser holder follower 44 reaches the apex 32*c* of the backward facing cam 32, the eraser holder 40 is at its highest point and the eraser 43 is in the extended position.

The location of the lead pencil refill 4 and its cam follower 33 relative to the forward facing cam 33 and the backward facing cam 32, and the relation between the forward facing cam 33 and the backward facing cam 32 allow for simultaneous axial movement of the eraser 43 to the extended position and the lead pencil 2 to the writing position.

The apex 32*c* of the backward facing cam 32 and the apex 33*d* of the forward facing cam 33 lie on parallel longitudinal planes. The apex 33*d* is also aligned with the slot 34*a* in the top opening 34 of the cam assembly 30. The channel 55 which slidably receives the lead holder 4 and its connected cam follower 33 is aligned with the projection 58 of the guide 50. Thus, the apex 32*c* urges the eraser holder follower 44 at approximately the same time when the apex 33*d* urges the step 63 of the cam follower 33 for the lead refill 4.

The projection 58 of the guide 50 is received in the slot 34*a* of the cam assembly 30 when the eraser 43 is propelled to its extended position. The engagement of the projection 58 and slot 34*a* allows for knocking of the eraser to forward lead 2 from the lead refill 4.

While a specific embodiment of the invention has been shown and described in detail to illustrate the application of the principles of the invention, it will be understood that the invention may be embodied otherwise without departing from such principles.

What is claimed is:

1. A multi-function writing instrument comprising:

a front section having a writing point opening;

at least three marking tips held inside the front section, said marking tips being alternately selectable for extension through the writing point opening to a use position, one of said marking tips being a pencil lead marking tip;

a rear section having an eraser opening, the rear section and the front section being rotatably connected to each other;

an eraser holder movably disposed in the rear section, the eraser holder being selectable for extension through the eraser opening, the eraser holder having an eraser follower;

an eraser mounted in the eraser holder;

a guide disposed in the front section, the guide having a plurality of channels;

a plurality of cam followers, each cam follower being slidably mounted in at least one of the plurality of channels, each cam follower being connected to a marking tip;

a means for biasing each cam follower toward the eraser opening;

a cam assembly rotatably connected to the guide, the cam assembly having a first cam face and a second cam face, the first cam face having a first cam path with a first cam apex for engaging the cam follower upon rotation of the cam assembly relative to the guide, the first cam apex biasing the cam follower toward the writing point opening, whereby the writing tip connected to the cam follower passes through the writing point opening, the second cam face having a second cam path with a second cam apex for engaging the eraser follower upon rotation of the cam assembly relative to the guide, the second cam apex biasing the eraser follower toward the eraser opening, whereby the eraser passes through the eraser opening upon rotation of the cam assembly relative to the guide; and a means for locking the guide and the cam assembly together against relative rotation when the cam follower connected to the pencil lead writing tip is urged by the first cam apex.

2. A multi-function writing instrument according to claim 1 wherein the first cam apex is aligned with the second cam apex.

3. A multi-function writing instrument according to claim 1, wherein the means for locking the guide and the cam assembly together against relative rotation comprises a guide projection extending from the exterior surface of the guide, a slot formed in the cam assembly, wherein the cam assembly is rotatably mounted to and axially slidable in the guide, the guide projection is shaped and sized to slidably engage the slot when the cam follower connected to the pencil lead writing tip is urged by the first cam apex.

4. A multi-function writing instrument according to claim 1, wherein the first cam apex lies on a first longitudinal plane and the second cam apex lies on a second longitudinal plane, and the first longitudinal plane and the second longitudinal plane are parallel.

5. A multi-function writing instrument according to claim 1, wherein:

the first cam path further includes a first sloped path, a second shorter sloped path, a short vertical path that extends from the second sloped path, and a circumferential path that is connected to the first sloped path and the second shorter sloped path, the circumferential path having at a plurality of recesses and a ridge between each recess, the first cam apex connecting the first sloped path and the short vertical path; and the second cam path further includes a slanted edge, a vertical straight edge, wherein the second cam apex is located between the slanted edge and the vertical straight edge.

6. A multi-function writing instrument comprising:

a front section having a writing point opening;

at least a pair of marking tips held inside the front section, said marking tips being alternately selectable for extension through the writing point opening to a use position, one of said marking tips being a pencil lead marking tip;

a rear section having an eraser opening, the rear section and the front section being rotatably connected to each other;

an eraser holder movably housed in the rear section, said eraser holder being selectable for extension through the eraser opening;

an eraser mounted in the eraser holder; and a means for propelling the pencil lead marking tip through the writing point opening and the eraser through the eraser opening upon rotation of the front section relative to the rear section.

7. A multi-function writing instrument according to claim 6, wherein the means for propelling comprises:

a guide connected to the front section, the guide having a first guide end, a second guide end, a plurality of channels extending between the first guide end and the second guide end;

a plurality of cam followers, each cam follower being slidably mounted in at least one of the plurality of channels, each cam follower being connected to a marking tip;

a means for biasing each cam follower toward the eraser opening;

an eraser follower connected to the eraser holder;

a first cam rotatably connected to the guide, the first cam having a first cam path with a first cam apex for engaging the cam follower upon rotation of the first cam relative to the guide, the first cam apex biasing the cam follower toward the writing point opening, whereby the writing tip connected to the cam follower passes through the writing point opening to the use position; and a second cam rotatably connected to the guide, the second cam having a second cam path with a second cam apex for engaging the eraser follower upon rotation of the first cam relative to the guide, the second cam apex biasing the eraser follower toward the eraser opening, whereby the eraser passes through the eraser opening upon rotation of the cam relative to the guide.

8. A multi-function writing instrument according to claim 7, wherein the first cam apex is aligned with the second cam apex.

9. A multi-function writing instrument according to claim 7, wherein the first cam and the second cam are connected to each other.

10. A multi-function writing instrument according to claim 7, wherein the first cam and the second cam form part of a cylindrical hollow body.

11. A multi-function writing instrument according to claim 10, wherein the cylindrical hollow body has a first opening and a second opening opposite the first opening.

12. A multi-function writing instrument according to claim 10, wherein the cylindrical hollow body is received in the rear section.

13. A multi-function writing instrument according to claim 10, wherein the first cam extends from an inner surface of the cylindrical hollow body.

14. A multi-function writing instrument according to claim 7, further comprising a means for locking the guide and the first cam together against relative rotation when the cam follower connected to the pencil lead writing tip is urged by the first cam apex.

15. A multi-function writing instrument according to claim 14, wherein the means for locking the guide and the first cam together against relative rotation comprises a guide projection extending from the exterior surface of the guide proximate the first guide end, a slot offset the first opening of the cylindrical hollow body, wherein the cylindrical hollow body is rotatably mounted to and axially slidable in the guide, the guide projection is shaped and sized to slidably engage the slot when the cam follower connected to the pencil lead writing tip is urged by the first cam apex.

16. A multi-function writing instrument according to claim 7, wherein the first cam apex lies on a first longitudinal plane and the second cam apex lies on a second longitudinal plane, and the first longitudinal plane and the second longitudinal plane are parallel.

17. A multi-function writing instrument according to claim 7, wherein the guide is rotatably mounted in the first cam.

18. A multi-function writing instrument according to claim 7, wherein the first cam path further includes a first sloped path, a second shorter sloped path, a short vertical path that extends from the second sloped path, and a circumferential path that is connected to the first sloped path and the second shorter sloped path, the circumferential path having at a plurality of recesses and a ridge between each recess, the first cam apex connecting the first sloped path and the short vertical path.

19. A multi-function writing instrument according to claim 7, wherein the second cam path further includes a slanted edge, a vertical straight edge, wherein the second cam apex is located between the slanted edge and the vertical straight edge.

20. A multi-function writing instrument according to claim 7, wherein the channels are located between a first partition proximate the first guide end and a second partition proximate the second guide end, the second partition having a plurality of openings, each opening being aligned with a channel.

21. A multi-function writing instrument according to claim 7, wherein the channels of the guide are circumferentially equidistant from each other.

22. A multi-function writing instrument according to claim 7, wherein the first guide end has a T-shaped opening.

23. A multi-function writing instrument according to claim 7, wherein each channel has a top opening defined by a channel edge on an exterior surface of the guide.

24. A multi-function writing instrument according to claim 23, wherein each cam follower includes a front platform, a bottom wall, a top wall and a raised profile having a step offset from the top wall of the cam follower, the raised profile extends from the front platform through the opening of the channel above the channel edge.

25. A multi-function writing instrument according to claim 24, wherein the step of the cam follower travels on the first cam upon rotation of the forward section relative to the rear section, the step sits in one of the recesses when the writing tip connected to the cam follower is inside the forward section, and upon rotation of the forward section relative to the rear section, the step travels on the recesses, climbs the first slope until it reaches and abuts against the first cam apex, the first cam apex pushes the cam follower against the force of the cam follower spring housed in the channel of the guide, causing the writing tip connected to the cam follower to pass through the writing tip opening.

26. A multi-function writing instrument according to claim 7, wherein a spline connection connects the eraser holder to the first guide end of the guide.

27. A multi-function writing instrument according to claim 7, further comprising a means for biasing the eraser holder toward the writing tip opening so that the eraser is housed in the upper barrel.

28. A multi-function writing instrument according to claim 27, wherein the eraser holder follower sits on an edge of the of the second cam when the eraser is inside the upper barrel, the eraser holder follower travels on the second cam path upon rotation of the second cam relative to the upper barrel, causing the eraser holder to move linearly against a force of the means for biasing the eraser holder, upon the eraser holder follower reaching the second cam apex of the second cam, the eraser is in the extendable position.

29. A multi-function writing instrument according to claim 7, wherein the propulsion of the eraser through the eraser opening is approximately simultaneous with the propulsion of the pencil lead through the writing tip opening.

30. A multi-function writing instrument according to claim 7, further comprising a plurality of holders, each holder having a first end and a second end, the first end being connected to one of the cam followers and the second end being connected to one of the writing tips.

31. A propulsion mechanism for a multi-function writing instrument, the propulsion mechanism comprising:

a guide adapted to be connectable to a front section of the multi-function writing instrument, the guide having a first guide end, a second guide end, a plurality of channels aligned with a center axis of the guide and extending between the first guide end and the second guide end;

a plurality of cam followers, each cam follower is slidably mounted in at least one of the plurality of channels, each cam follower adapted to be connectable to a marking tip;

a means for biasing each cam follower toward the second guide end;

an eraser holder adapted to be movably housed in a rear section of the multi-function writing instrument;

an eraser follower connected to the eraser holder;

a first cam rotatably connected to the guide, the first cam having a first cam path with a first cam apex for engaging the cam follower upon rotation of the first cam relative to the guide, the first cam apex biasing the cam follower toward the first guide end; and a second cam rotatably connected to the guide, the second cam having a second cam path with a second cam apex for engaging the eraser follower upon rotation of the first cam relative to the guide, the second cam apex biasing the eraser follower toward the eraser opening upon rotation of the cam relative to the guide.

* * * * *